US006629380B2

(12) United States Patent
Yeargin

(10) Patent No.: US 6,629,380 B2
(45) Date of Patent: Oct. 7, 2003

(54) HANDGUN REST FOR FIELD AND HUNTING USE

(76) Inventor: William D. Yeargin, Box 336, Circleville, NY (US) 10919-0336

( * ) Notice: Subject to any disclaimer, the term of this patent is extended or adjusted under 35 U.S.C. 154(b) by 0 days.

(21) Appl. No.: 10/337,557

(22) Filed: Jan. 7, 2003

(65) Prior Publication Data

US 2003/0140543 A1 Jul. 31, 2003

Related U.S. Application Data

(63) Continuation-in-part of application No. 09/444,433, filed on Nov. 22, 1999, now Pat. No. 6,539,660.

(51) Int. Cl.[7] ..... F41C 29/00
(52) U.S. Cl. ..... 42/94
(58) Field of Search ..... 42/94; 89/37.04, 89/40.06

(56) References Cited

U.S. PATENT DOCUMENTS

| | | | | |
|---|---|---|---|---|
| 271,251 | A | 1/1883 | Leerbech et al. | |
| 1,441,285 | A | 1/1923 | Johnston et al. | |
| 1,524,973 | A | 2/1925 | Hazelton | |
| 1,618,966 | A | 2/1927 | Bull | |
| 2,168,988 | A | 8/1939 | Hultquist | |
| 2,427,365 | A | 9/1947 | Meister | 81/38 |
| 2,877,689 | A | 3/1959 | Pribis | 89/37 |
| 3,125,929 | A | 3/1964 | Peasley | 89/37 |
| 3,327,422 | A | 6/1967 | Harris | 42/94 |
| 3,445,082 | A | 5/1969 | Proctor et al. | 248/186 |
| 4,351,224 | A | 9/1982 | Curtis | 89/37 |
| 4,438,581 | A | 3/1984 | LaValle | 42/94 |
| D276,668 | S | 12/1984 | Minneman | D3/7 |
| 4,607,561 | A | 8/1986 | Frimer | 89/37 |
| 4,625,620 | A | 12/1986 | Harris | 89/37 |
| 4,972,619 | A | 11/1990 | Eckert | 42/94 |
| 5,029,407 | A | 7/1991 | Kirkpatrick | 42/94 |

(List continued on next page.)

FOREIGN PATENT DOCUMENTS

| | | |
|---|---|---|
| DE | 2255062 | 5/1974 |
| FR | 537703 | 6/1921 |
| FR | 1457599 | 11/1966 |

OTHER PUBLICATIONS

American Rifleman, p. 38, Jun., 1995.
"Long–Range Bolt Pistols," American Rifleman, pp. 26–27, Jan., 1999; "Savage Arms," Shooting Times, p. 106, Sep., 1999; and "Contender Hunter" advertisement.
Harris Engineering, Inc., Series 1A2 Model L Bipod product information.
Pistolero Handgun Shooting Rest# 539–066 product information.
Pistol Perch Handgun Rest# 40836 product information.
Product information for various bipods including Stony Point Monopod, Cabelas 1996 catalog, p. 421; and Lock, Stock & Barrel, 1998.

(List continued on next page.)

*Primary Examiner*—Michael J. Carone
*Assistant Examiner*—Troy Chambers
(74) *Attorney, Agent, or Firm*—Cook, Alex, McFarron, Manzo & Cummings & Mehler, Ltd.

(57) ABSTRACT

A handgun rest suitable for field use includes a shooting platform on which the shooter rests the butt of the handgun grip and one or both hands. A first extension member is rotatably coupled to the front of the platform. A second extension member is rotatably connected to the far end of the first extension member. The second extension member nests within the first extension member in the closed position, and, in turn, both extensions rotate onto the platform in the closed position. To open the rest, the shooter rotates the first and second extension members together to a stop and then may then rotate the second extension member relative to the first extension member to a second stop. Along the way, the shooter can secure the angular position of either extension member by tightening a nut to draw together arms of the extension, thereby engaging serrations with a washer through which a pin passes. The weight of the handgun is supported fore and aft, including the shooter's hand or hands.

25 Claims, 9 Drawing Sheets

U.S. PATENT DOCUMENTS

| | | | | | |
|---|---|---|---|---|---|
| 5,074,188 | A | | 12/1991 | Harris | 89/37 |
| 5,194,678 | A | | 3/1993 | Kramer | 42/94 |
| 5,375,337 | A | | 12/1994 | Butler | 33/506 |
| 5,377,437 | A | | 1/1995 | Underwood | 42/94 |
| 5,406,732 | A | | 4/1995 | Peterson | 42/94 |
| 5,419,233 | A | * | 5/1995 | Mulvaney | 89/37.04 |
| 5,600,913 | A | | 2/1997 | Minneman | 42/94 |
| 5,617,666 | A | | 4/1997 | Scott | 42/94 |
| 5,628,135 | A | | 5/1997 | Cady | 42/94 |
| 5,661,919 | A | | 9/1997 | Pryor | 42/94 |
| 5,666,757 | A | | 9/1997 | Helmstadter | 42/94 |
| D387,123 | S | | 12/1997 | Hughes et al. | D22/199 |
| 5,711,103 | A | | 1/1998 | Keng | 42/94 |
| 5,715,624 | A | | 2/1998 | Hilbelink et al. | 42/94 |
| 5,715,625 | A | * | 2/1998 | West, III | 42/94 |
| 5,740,625 | A | | 4/1998 | Jenkins | 42/94 |
| 5,778,589 | A | * | 7/1998 | Teague | 42/94 |
| 5,794,899 | A | | 8/1998 | Tamllos | 248/166 |
| 5,815,974 | A | | 10/1998 | Keng | 42/94 |
| 5,833,308 | A | * | 11/1998 | Strong et al. | 297/172 |
| 5,845,427 | A | * | 12/1998 | Taylor | 42/94 |
| 5,884,966 | A | * | 3/1999 | Hill et al. | 297/170 |
| 5,930,932 | A | | 8/1999 | Peterson | 42/94 |
| 5,964,435 | A | * | 10/1999 | Peltier | 248/166 |
| 6,044,747 | A | * | 4/2000 | Felts | 89/40.06 |
| 6,058,641 | A | * | 5/2000 | Vecqueray | 42/94 |
| 6,269,578 | B1 | * | 8/2001 | Callegari | 42/94 |
| 6,539,660 | B1 | * | 4/2003 | Yeargin | 42/94 |

OTHER PUBLICATIONS

Firearm rests, Cabelas 1996 catalog, p. 420.

Pistol rests, MTM 1998 catalog, p. 4.

"An Incredible Piece of Engineering," B–Square Catalog, 1996.

"B–Square Monopod" product information.

Shooting Rests Internet Catalog: http://www.shootingrests.com/Shooting_Rest/Pistol_Rest/pistol_rest.html.

TJ General Store Internet Catalog: http://tjgeneralstore.com/outers.htm.

B–Square Internet Catalog:_ http://www.reliablehost.com/bsquare/bipods.html.

OH Products Internet Catalog: http://www.bullshootersighting.com/pistol.htm.

Gunstands Internet Catalog: http://www.gunstands.com/bench.htm.

* cited by examiner 58
66H
66
66T
40R
40L
68
72
72A
72B
72C
72D
72E
80R
74
74A
74B
74C
74D
74E
80L 72A
74A

HANDGUN REST FOR FIELD AND HUNTING USE

This is a continuation-in-part of my (and allowed) application Ser. No. 09/444,433 filed Nov. 22, 1999 now U.S. Pat. No. 6,539,660.

FIELD AND BACKGROUND OF THE INVENTION

The present invention relates to shooting rests for firearms, especially handguns.

Since the development of firearms, numerous shooting rests have been devised to aid accuracy, and to be useful, any shooting rest must provide support for the firearm itself and serve to steady the shooter also. As firearms have become more efficient, aided with high magnification optical sights, precision shooting at long range has become the norm. This mandates that a shooting rest be used to achieve a measure of acceptable accuracy. This requirement becomes most evident when a handgun is used for long range shooting.

Generally, shooting rests comprise monopods, bipods, and tripods; rests designed for bench shooting; and rests which attach to the forearm of the gun. The maiority of shooting rests, however, whether designed for field or bench use, are intended for rifles. For field or hunting applications, these shooting rests generally take the form of a bipod attaching directly to the rifle itself, or are designed to be carried as a separate component in the form of a mono-pod, bipod, or tripod device of different variations. Whether designed to be used in the prone, sitting, kneeling, or standing positions, these shooting rests are generally effective because a rifle while rested at the forearm (under the barrel) is also supported by the shooter's body, anchored at the shoulder, resulting in both the rifle and shooter being supported fore and aft. Because a rifle has a shoulder stock, this kind of shooting rest works well with any long-arm.

Handguns have a different shape and thus present a different problem. For using handguns in the field or when hunting, prior art shooting rests are not effective for accurate. long-range shooting. Unlike rifles, handguns are fired at arm's length, without the benefit of a shoulder stock. A shooting rest that rests only under the forearm or barrel leaves unsupported the handgrip, and more importantly the shooter's wrists and arms. Conversely, if a shooting rest supports the butt of the handgrip, the front of the handgun is left unsupported. Skilled shooters acknowledge that except for shooting at close range with iron or open sights, long range accuracy can be achieved only when the handgun is supported both fore and aft, and only when solid support is provided for the weight of the shooter's wrists and arms.

Handguns for long range, precision shooting generally are fitted or equipped with optical (telescopic) sights, and are represented by single shot and bolt action pistols or large frame revolvers. The combined handgun with sight is heavy and long, precluding offhand shooting. Also, these are single shot bolt action pistols or large frame revolvers. These handguns can be used at target shooting ranges, where a substantial bench rest can be configured to support the fore and aft portions of the weapon. However, bench rests are unsuitable for or inapplicable to field and hunting applications.

Monopod gun supports, represented by U.S. Pat. Nos. 5,740,625 or D276,668, offer no support for both fore and aft portions of a handgun. They are the least steady type of rest, even for rifle use, and almost must be pushed into the ground to be steady. They offer no adjustment provisions beyond height. They are, however, portable and simple.

Bipod gun supports, represented by U.S. Pat. No. 5,930,932 and U.S. Pat. No. 5,377,437, are still portable and steadier than monopod gun supports, but they still are inadequate for steady handgun shooting, notwithstanding their assertions to the contrary, due to their lack of the prescribed support. They are good for rifles, but not handguns.

Tripod gun supports such as U.S. Pat. No. 5,794,899 are big, bulky, and not highly portable. They are designed for camera use and are too complex for field use.

Bench rests are exemplified by U.S. Pat. Nos. 5,628,135; 4,438,581; and 5,600,913. They offer handguns support at both fore and aft. They are not designed for field use, due to their weight and bulk, or their rudimentary design. Such rests are clearly for bench use.

Scott U.S. Pat. No. 5,617,666 discloses a bench rest for supporting a rifle or handgun at one rest point only, rather than two points. The Scott rest has a pair of links 14, 16 that fold onto the top of a platform 12. Both links are rotationally connected to the platform via a threaded shaft 18 that runs up and down most of the length of the platform, and is centered left to right on the upper surface thereof. A traveling nut cooperates with at least one of the links and the shaft. In both the operative position and the closed position, the links and supporting mechanism occupy the center of the platform, leaving no room on the platform for the shooter to rest the butt of a handgun or the hand which is holding the handgun. This is shown in Scott's FIG. 6 perspective view showing the barrel of a handgun supported on a rest bag 58 on the free end of first link 14. The hand holding the gun is rearward of the entire gunrest.

Mulvaney U.S. Pat. No. 5,419,233 is another bench rest that is usable for both rifles and handguns. It includes a large table panel 10, a movable rear support member 13 that is positionable longitudinally along the table panel, a forward support member 12 connected to a positioning lever 31, and an arrangement of springs and a pair of collars 34 that the shooter slides up or down the front legs 11. This is clearly not appropriate for field or hunting use with a handgun due at least to its large size, as shown in its FIG. 3, showing that the length of this rest is about twice the length of the handgun.

Another rest is represented by U.S. Pat. No. 5,666,757. It is not clear whether this is a bench rest, a monopod, or intended for hunting. Contrary to its assertions, it is not lightweight. Moreover, it is impractical to anchor the rest into the ground. Also, the center of gravity is incorrect, and the device is not portable.

Yet another gunrest style is represented by Kirkpatrick U.S. Pat. No. 5,029,407 and Harris U.S. Pat. No. 4,625,620. The Kirkpatri for supporting a rifle, but it fails to support both the fore and aft portions of a handgun simultaneously. This design requires attachment to the firearm itself, thus making a handgun very cumbersome. Also, this design does not adapt to all handguns. It requires support under the shooter's hands when used in a prone shooting position, and it does not suffice from the sitting position, which is the more useful position in the field.

Hilbelink U.S. Pat. No. 5,715,624 is for a handgun rest and offers a structure beneath fore and aft portions of the pistol. However, the shelf thereof (referred to by numeral 27) is not directly supported. Rather, the support is fashioned beneath the forearm or barrel, leaving the hands and arms of the shooter inadequately supported and apparently unstable. The point of support is offset from the weight of the shooter's hands and the majority of the weight of the gun.

Moreover, the gunrest shown and described there would appear to need to be pushed into the ground, which is a disadvantage.

Each of the prior art designs, whether an attached bipod or separate device, is compromised in one or more ways. Therefore, the present invention seeks to provide a handgun shooting rest that meets all or several of these several criteria, it is suitable for field use; it offers fore and aft support for both hands and the pistol forearm or barrel; it allows the majority of the weight of the handgun and the weight of the shooter's hands and wrists to be disposed directly above the support; it is compact and easily carried; it is adaptable to both prone and sitting positions due to varying terrain conditions; and it is capable of rapid deployment. One of the embodiments it offers a mechanism accommodating at least one but preferably both of swivel and canting movement, i.e. rotation in two orthogonal dimensions, for target acquisition and adjustment to uneven ground.

SUMMARY OF THE INVENTION

A handgun rest suitable for field use supports the weight of the handgun both fore and aft and includes a shooting platform on which the shooter rests the butt of the handgun grip and one or both hands that grip the weapon. A first extension member has a first end which is coupled rotatably to the forward part of the platform, preferably at or associated with the front of the platform. The first extension member has a second end that is distally spaced from the first end. The first extension member preferably includes a first cross member that can be used for supporting a gun barrel or other forward portion of the gun at the second end of the first extension member. Preferably the first extension member is rotatable from a closed (or storage) position, in which the first extension member may conveniently lie upon the upper surface of the platform, to an operating position where the second end is positioned upward of the upper surface of the platform and preferably forward from the front edge of the platform. Preferably the first extension member is rotatable through at least about ninety degrees (90°). Preferably the first extension member in the operating position angles upward and forward to provide both the required amount of upward rise and forward extension to come under, and provide the rest for, a forward portion of the gun, e.g. its forearm or barrel when the grip is rested on the platform.

Preferably the gun rest includes a second extension member having a first end and an opposed, distally spaced second end, the first end preferably being rotatably coupled to the second end of the first extension member. Preferably the second extension member includes or is associated with a second cross member which may support the forward portion of the hand gun.

The first extension member, being coupled nearest to the platform, may be referred to as an "inner" extension member. The second extension member, being rotatably coupled at the second end of the inner extension member, may be referred to as an "outer" extension member. The cross member at the second end of the first cross member may be referred to as an inner cross member, and the cross member at or associated with the second end of the second cross member may be called an "outer" cross member.

Preferably, the gun rest of the preferred embodiment is opened in a two-step process. In the closed position, preferably the first and second extension members are nested together and lie upon the upper surface of the platform. To open the rest, the shooter rotates the first and second extension members together through an angle that is preferably about ninety degrees (90°) or more. (This leaves the platform clear for supporting the hands and gun.) Then the shooter rotates the second extension member into position.

Preferably the gun rest of the preferred embodiment is closed by rotating the second extension member into alignment with the first extension member, and then the two extension members are rotated together, at once, onto the upper surface of the platform.

The platform of the rest preferably includes threaded fittings on a bottom surface so that the platform may be supported by a tripod, bipod, or monopod, as the shooter desires. In addition, the platform preferably has feet or pads so that it may be used upon a bench when that is available at a shooting range, for example.

BRIEF DESCRIPTION OF THE DRAWINGS

A greater appreciation of the present invention will be gained from consideration of the following detailed description of preferred embodiments thereof, in which reference is made to the accompanying drawings wherein.

DESCRIPTION OF THE PREFERRED EMBODIMENTS

Introduction

Figure 1:
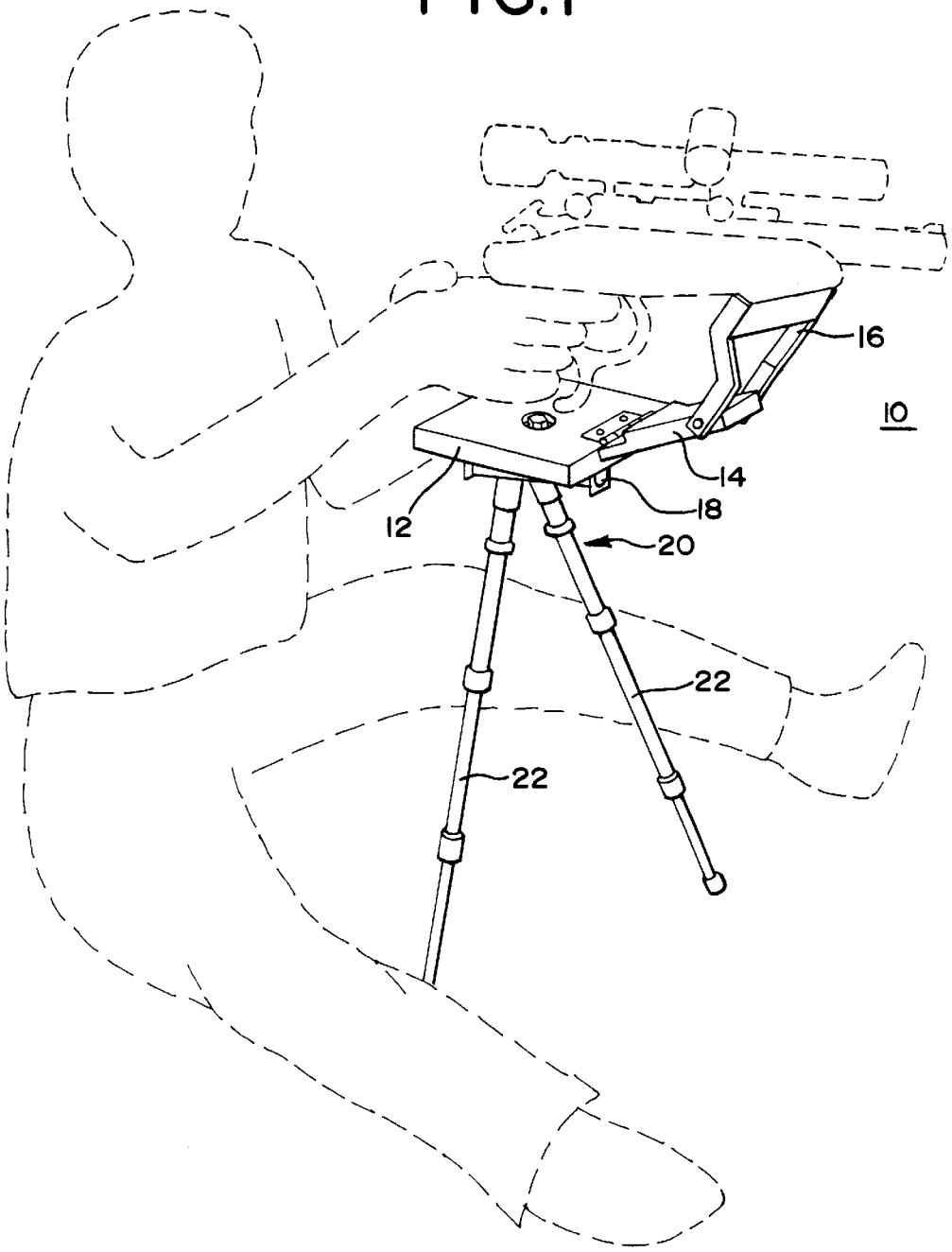
FIG. 1 is a perspective view showing in phantom a shooter in a sitting position utilizing a handgun rest according to a first embodiment of a gunrest.

My priorpatent application Ser. No. 09/444,433 filed Nov. 22, 1999, now allowed and proceeding to issuance, is incorporated by this reference thereto and discloses a gun rest 10 having platform assembly 12, a first extension member 14 and a second extension member 16. First extension 14 has a first end that is rotatably coupled at a front portion of platform 12 and a second end distally located from the first end. Second extension 16 has a first end that is rotatably coupled to the second end of first extension 14. It has a second end with a cross member that may support the barrel or other forward portion of the handgun. It opens from a compact, storage position by sequential rotating steps. In the first step, the shooter rotates the first and second extension members together away from the upper surface of the platform. In a second step, the shooter rotates the second extension member away from the first extension member.

The improved embodiment 100 includes the aforementioned features but includes certain further refinements.

Detailed Description of the First Embodiment

Referring now to the drawings, a handgun rest embodying the principles and concepts of the present invention is shown in FIGS. 1 to 7, the handgun rest indicated generally by the numeral 10 as described herein.

Figure 2:
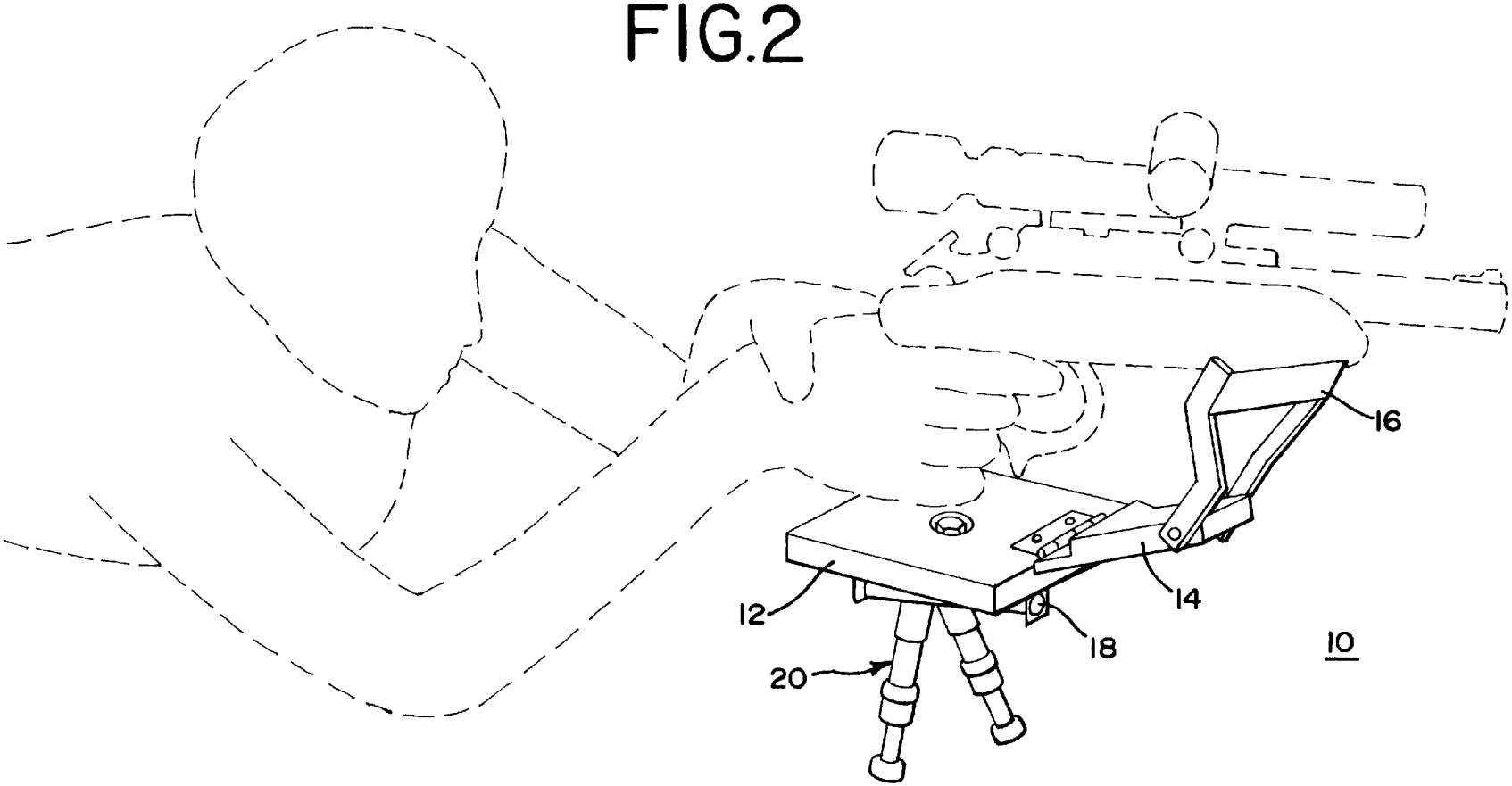
FIG. 2 is a perspective view, showing in phantom, a shooter utilizing the handgun rest of FIG. 1 but from the prone position with the leg extensions removed.

Turning first to FIGS. 1 and 2, a shooter is shown in phantom utilizing the handgun rest 10 in both sitting and prone shooting positions respectively. The sitting position, due to varying terrain, along with grasses and vegetation, has proven to be the more useful field position. Generally speaking, the major components of gun rest 10 comprise a shooting platform assembly 12, a first or "inner" extension 14 and a second or "outer" extension 16 extending from the inner extension 14. A bracket assembly 18 is secured under shooting platform assembly 12 so as to provide rotational movement to shooting platform assembly 12 (e.g. swiveling around a pivot member). A bipod leg assembly 20 is adjustably coupled to bracket assembly 18 so as to provide canting movement (e.g. rotation around an axle member that is perpendicular to the pivot member). FIGS. 1 and 2 show the major components and their relationship described herein. FIG. 1 additionally shows leg extensions 22 which can be utilized in the sitting, kneeling, or prone shooting positions. As will be appreciated by those skilled in the art, handgun rest 10 provides comprehensive support, making long range accuracy possible.

Figure 3:
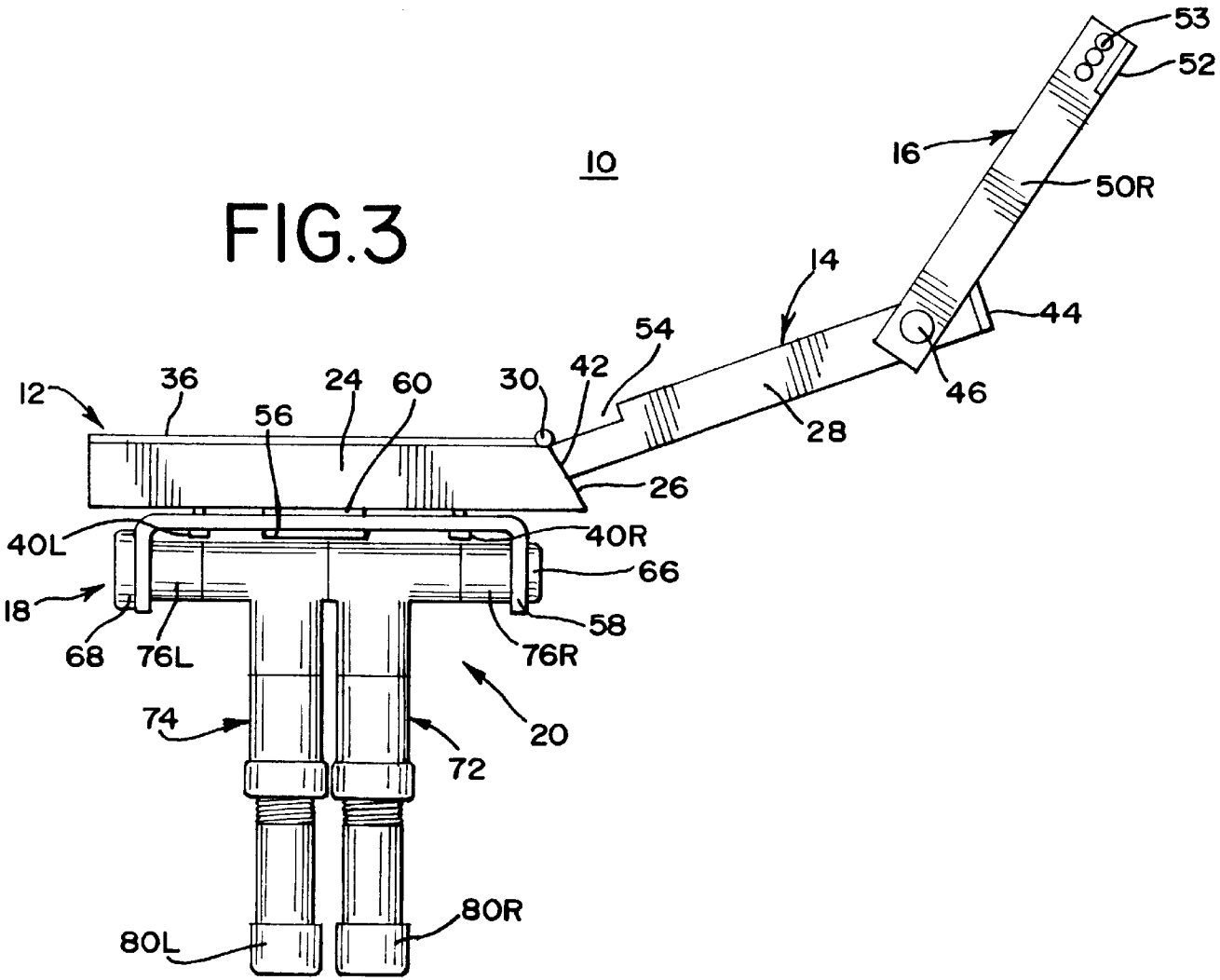
FIG. 3 is a side view of the handgun rest of FIG. 1 with its two extension members in the fully extended position.

More specifically, as noted in FIG. 3, shooting platform assembly 12 includes a platform 24 on which the butt of the handgun grip, along with the shooter's hands, may be rested, thus providing rear support. Preferably, platform 24 is sized to a minimum dimension, still allowing for the largest hands. Illustratively, platform assembly 12 is generally square or rectangular, although other shapes can be used. Illustratively, the platform can have a nominal size of about 5½ inches long by about 4 to 4¼ inches wide. As an optional feature, the top of platform 24 may have fitted thereto or formed thereon a notch, groove, or other abutment (not shown) against which the pistol grip or base may be abutted in use for further stabilization At the forward side of platform 24 is an angled front face 26, the angle of which, as shown in FIG. 3, is not vertical but instead preferably is less than ninety degrees from horizontal.

Figure 6:
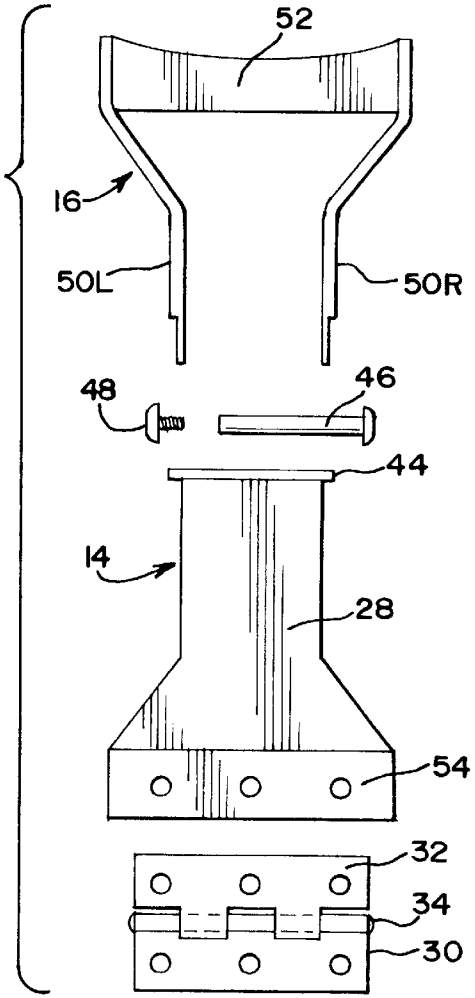
FIG. 6 is a plan view of both the inner and outer extensions of the FIG. 1 embodiment, shown separated for component viewing purposes.

A first or inner extension 14, which may advantageously be seen in FIG. 6, includes an extension body 28 which preferably articulates with respect to the shooting platform assembly 12. Preferably, inner extension 14 is rotatably mounted on platform assembly 12 by means of a hinge or other articulating mechanism. The hinge permits inner extension 14 to articulate from a storage position (folded back upon the top of platform 24) to a position for use, where it is supported by and rests on angled front face 26 so that inner extension 14 extends forward and upward, above the horizontal plane. FIG. 3 shows the edge of one portion 30 of the hinge.

An expanded view of the inner and outer extensions and the connections is shown in FIG. 6. The bottom of FIG. 6 shows a hinge having three elements 30, 32, 34. The hinge is to be connected at the front edge of platform 24. This is shown in FIG. 6 for explanatory purposes only as a conventional type hinge consisting of a female hinge part 30, a male hinge part 32, and hinge pin 34. In a preferred version the hinge or articulating mechanism would be integral with platform 24, that is, only the hole to receive hinge pin 34 would exist. Other types of hinges or other connecting devices for rotational coupling between inner extension 14 and platform 24 can be used.

Returning to FIG. 3, platform assembly 12 preferably further includes a neoprene cushion 36 or similar material applied to the top of platform 24 for cushioning and skid resistance.

Figure 5:
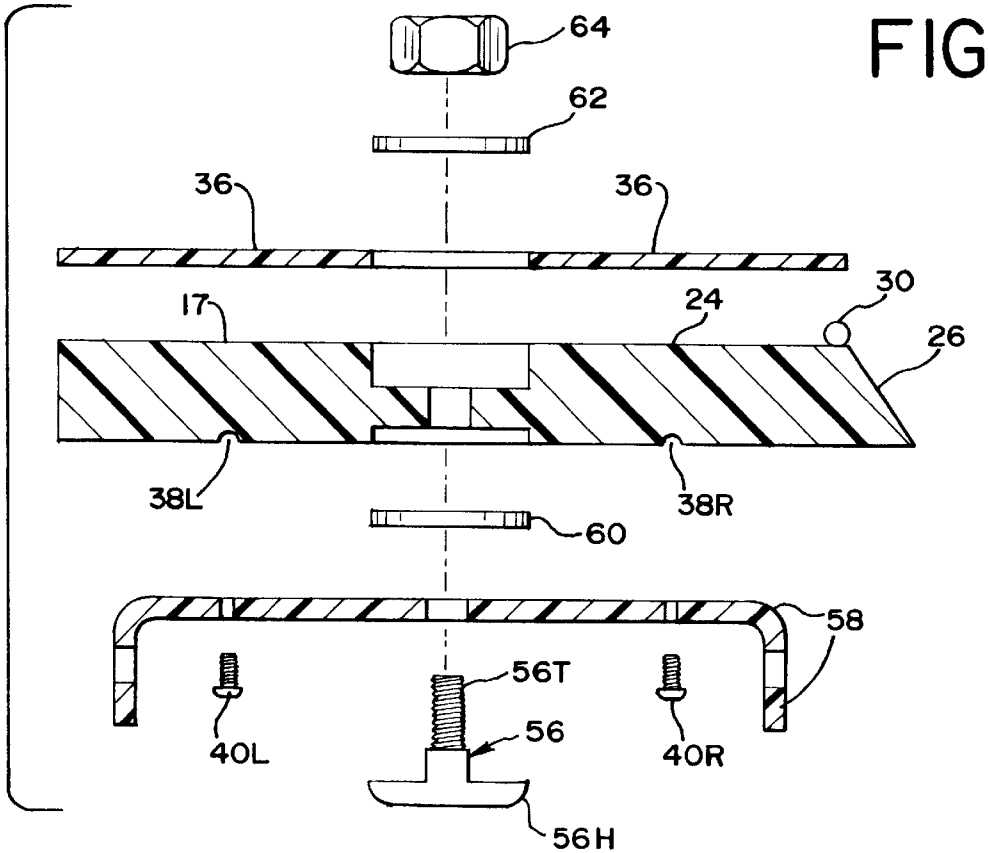
FIG. 5 is a cross-sectional view of the shooting platform of FIG. 1, along with a bracket assembly which secures thereto.

FIG. 3 also shows leg assembly 20 connected beneath platform 24. Illustrative details of a connection between the leg assembly and the platform are seen in FIG. 5. The preferred connection is rotatable, i.e. allows rotation between the platform and the leg assembly. To that end, the bottom surface of platform 24 has a left recess slot 38L and right recess slot 38R. These engage a left rotation limit screw 40L (FIG. 5) and a right rotation limit screw 40R, both of which secure through bracket assembly 18, serving to limit the rotation of platform 24 and orient the entire assembly front and rear. Rotational movement thus results with simple directional pressure from the user. Further details of the rotational connection are given with respect to the discussion below of FIG. 5.

FIG. 3 further shows from a side elevation the relationship of inner extension 14 and outer extension 16 to shooting platform assembly 12. Specifically, an extension body 28 is joined to platform 24 by means of the hinge, one portion 32 of which is integral with extension body 28, by means of hinge pin 34 passing through both hinge members 30 and 32. Extension body 28 includes an extension body interface 42, and when body 28 is rotated about pin 34 into the operative position, interface 42 comes into abutment with a platform interface 26. As noted above, extension 14 preferably does not rotate a full one hundred eighty degrees (180°) but instead comes to rest at an angle above the horizontal.

The first (inner) extension includes an outer extension stop member 44 at the forward end of extension body 28. The outer extension 16 assembly is rotatably coupled to extension body 28 illustratively by means of a screw post 46 and threaded screw 48, passing through, in sequence, a right side extension upright 50R, extension body 28, and a left extension upright 50L, as best seen in FIG. 6. At the free end of outer extension 16, a cross-member 52 is connected between the left and right extension uprights 50R and 50L. Cross member 52 cradles and provides the support for the handgun forearm or barrel, as applicable. As can be seen in FIG. 3, in the operative position, both inner extension 14 and outer extension 16 assemblies extend upwards and outwards, providing the predetermined amount of upwards rise and forward extension. As an alternate, stop pins could be used in lieu of outer extension stop 44. Other mechanisms can be used to limit the angle between the outer and inner extensions 14 and 16, respectively.

Figure 4:
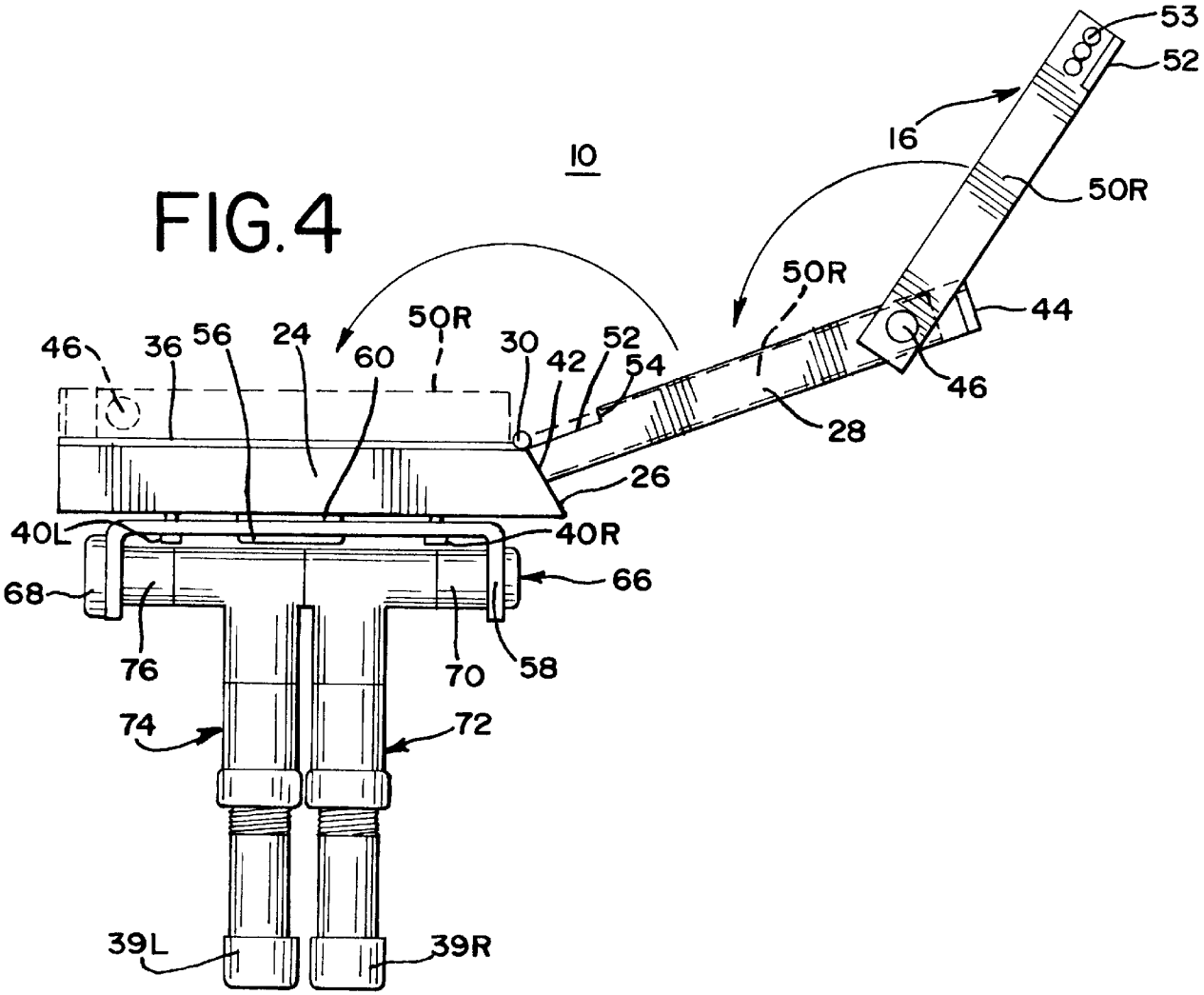
FIG. 4 is a side view of the handgun rest of FIG. 1 to marked illustrate, through the use of arrows, the second (outer) extension folding onto the first (inner) extension, which in turn folds back onto the shooting platform.

FIG. 4, through the use of directional arrows and phantom lines. shows outer extension 16 folding back onto inner extension 14, with cross-member 52 being received and fitting flush into a cross-member receiving slot 54, which in turn, because of the hinged arrangement between inner extension 14 and platform 24, folds back onto shooting platform assembly 12. This creates a compact and easily transportable package with a minimum of motion or effort. The parts comprising inner and outer extensions 14 and 16 are particularly detailed in FIG. 6. It will be appreciated that the present invention in some of its aspects can be practiced without the folding or compacting features. Thus, the movable elements described here can be made fixed, i.e. other structure can be used. The parts may be welded or formed integrally, or they could be separate parts that are fixedly joined by screws, pins, welds, rivets, or the like. Another embodiment can collapse in another fashion, such as, for example, by telescoping the outer extension onto or into the inner extension, with a suitable detent or other mechanism to hold the two extensions in the fully open position.

It may be noted that because the hinge members 30 and 32 are intended to be integral with platform 24 and extension body 28 respectively, the depth or thickness of extension body 28 directly under the cross-member receiving slot 54 can be increased from that shown. This dimensional increase at this specific point would serve three purposes. First, the size of the contact area at platform interface 26 and extension body interface 42 would be increased. Second, it would allow the cross-member receiving slot 54 depth to be increased, thereby allowing that cross-member 52 be increased in depth a like amount. Third, adjustment screws could be provided through the underside of extension body 28 angling through extension body interface 42, making contact with platform interface 26. Via these adjustment screws, small adjustments could now be accomplished, allowing for dimensional differences in handguns. In a further variation, cross-member 52 could be supplied either fixed or removable, and if removable, alternate cross-members 52 would be provided each with varying curvatures, providing yet further means of adjustment. Thus, a plurality of cross members can be supplied, each differing from the others, typically in height, thickness, or curvature. An additional variation that can be added is an adjustment for the position of cross member 52 relative to the outer extension uprights 50L, 50R. This can be achieved, illustratively, by forming a channel in the uprights with a detent or other fastener to engage cross member 52 at various predetermined positions relative to the uprights. Of course, more permanent fasteners in the form of screws can be used to connect member 52 to the uprights, and plural screw holes (not illustrated) can be provided so that the user may select a pair of screw holes in which to mount the cross member 52 so that it best fits the gun to be used. Other mechanisms to provide linear selectable movement of cross member 52 relative to uprights 50L, 5OR are within the scope of this invention. This is one height adjustment that can be used for adjusting the position at which cross member 52 engages or cradles the barrel or forearm of the weapon.

Figures 7, 7A:
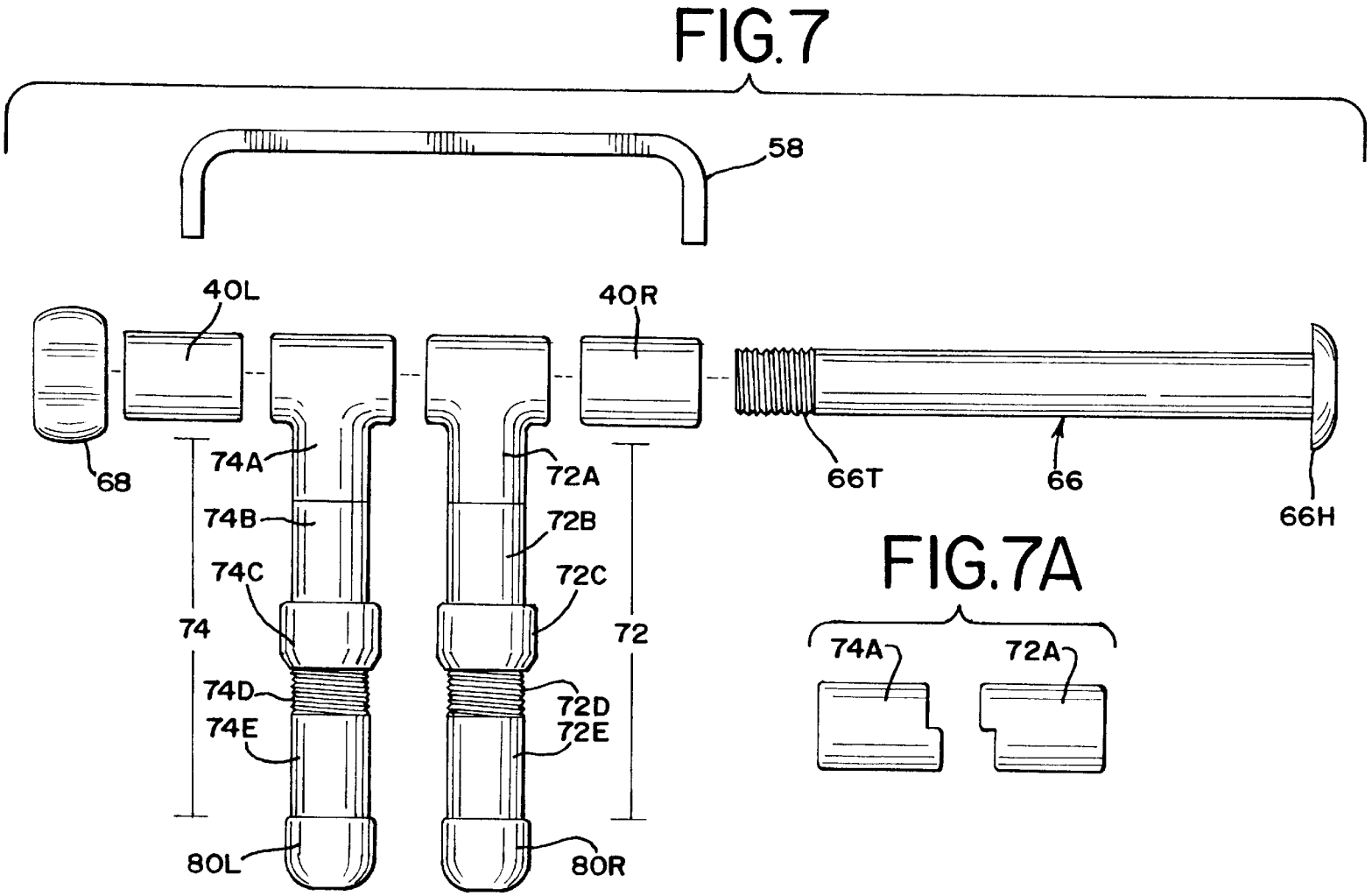
FIG. 7 is an expanded side view of the components forming the preferred leg assembly in the FIG. 1 embodiment, which in turn are secured within the bracket attaching to the bottom of the shooting platform.
FIG. 7A is a top elevational view of the two legs, showing the interface between them and the preferred method of limiting the angular relationship of the legs in the FIG. 1 embodiment.
Figure 10:
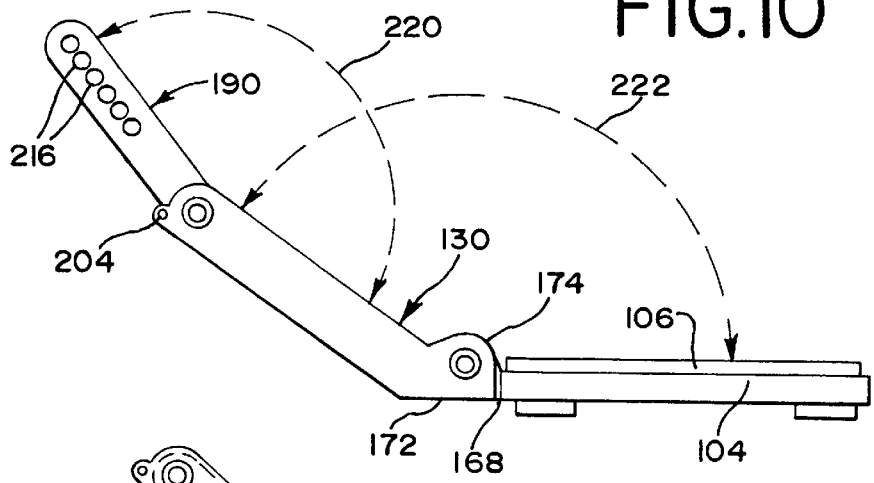
FIG. 10 is a representative side view sketch for the embodiment of FIG. 8 in a primary configuration for use in the field, where the outer cross member is positioned to support the barrel or forward portion of the gun at an elevated position forward of the platform.

FIG. 7 shows some of the parts below the platform assembly 12 in an expanded view. The actual relationship is better depicted in FIGS. 3 and 4. In FIG. 7, the bipod leg assembly 20 comprises a horizontally oriented bracket carriage bolt 66, a right spacer 76R, a right leg 72, a left leg 74, a left spacer 76L, and thumbnut 68. More specifically, bracket carriage bolt 66 having a smooth shank, head section 66H, and threaded section 66T, passes through bracket 58 at one end. Sandwiched within bracket 58, bracket carriage bolt 66 passes through right spacer 76R, right leg 72, left leg 74, and left spacer 76L. Bracket carriage bolt 66 exits bracket 58 at the opposite end, where it is secured with thumbnut 68. This arrangement makes it possible for the bipod leg assembly 20 to rotate within bracket 58, providing a canting feature for handgun rest 10, as shown in FIG. 10. The amount of resistance to canting, when directional pressure is applied by the shooter, is determined by tensioning thumbnut 68 and the subsequent squeezing of bracket 58 on the bipod leg assembly 20. Left leg 74, while an integral unit, is comprised of a top section 74A, upper shank 74B, knurled or wrench flats section 74C, threaded section 74D, and lower shank 74E. The threaded section of the leg 74D is positioned so as not to come in contact with the ground when handgun rest 10 is used in the prone position. Leg is terminated with a cap 80L of the same diameter as the lower shank 74E. The companion leg 72 of the bipod has similar members 72A, B, C, D, and E, as well as a similar cap 80R.

FIG. 7A shows a view of leg top sections 72A and 74A, and provides for an interface which limits the maximum spread of the bipod to a preselected angular relationship, nominally 25 degrees. Any angle less than the maximum can be utilized, resulting in height adjustment of shooting platform assembly 12 from ground level.

Detailed Description of the Improved Embodiment

Figure 8:
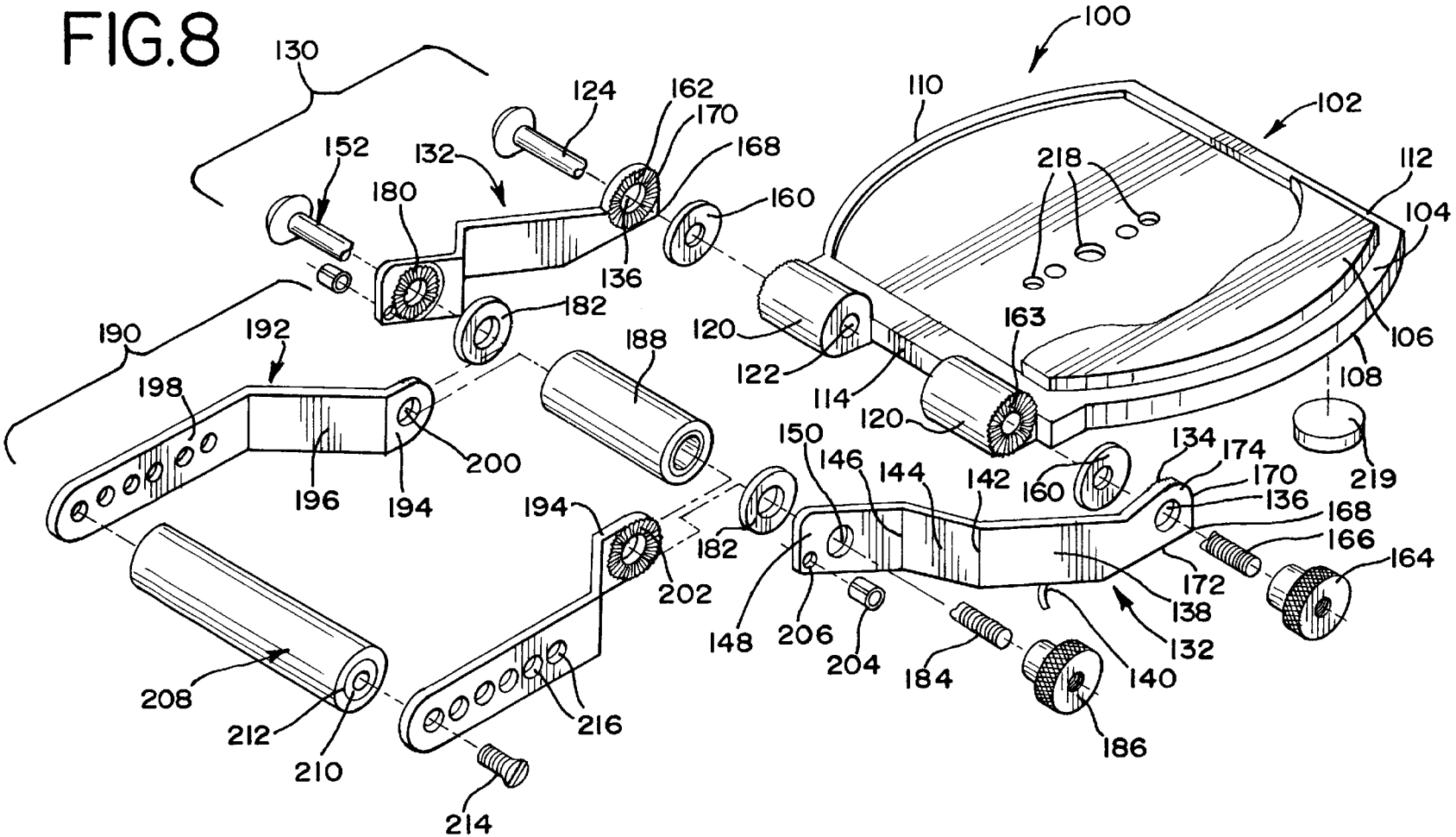
FIG. 8 is an orthogonal, exploded view with some parts broken away of an improved, second embodiment of a gun rest according to the present invention.
Figure 9:
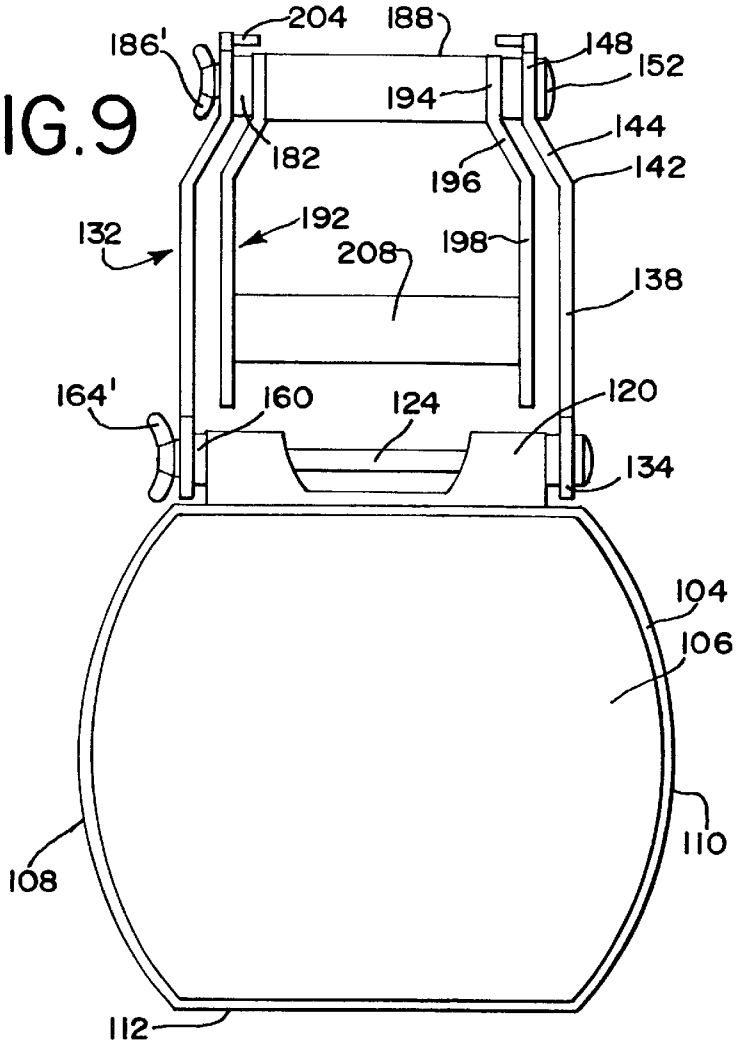
FIG. 9 is a plan view of the improved preferred embodiment of FIG. 8 in a partially opened, partially closed position.

FIG. 8 is an exploded orthogonal view with some parts broken away of an improved hand gun rest 100 suitable for use in the field or upon a table at a shooting range. This rest embodies several of the innovative aspects of the first embodiment which is described in my pending patent application and above. Referring to FIG. 8 and FIG. 9, which shows the gun rest 100 in a different view, the improved rest includes a platform 102 which preferably comprises a rigid or metallic base 104 and a resilient pad 106 on the upper surface thereof. The shape of the platform 102 in plan view may be rectangular if as in the first embodiment but in the currently preferred form has convex curved side edges 108, 110. The size of platform 102 is much smaller than the size of a table in a table rest as would be used for a rifle. The width of a platform for holding a man's hand wrapped around the grip of a handgun, and with the butt of the gun resting on the platform, is typically on the order of three to four inches. If the shooter is a man using two hands to grip the handgun, the platform required to support the butt of the gun and the bottom of the two hands wrapped around the grip of that gun is on the order of about four to about six inches wide. Accordingly, side edges 108, 110 of the platform 100 illustratively have a maximum left-to-right span of six inches. That maximum width is typically at about the midpoint of the platform, front-to-back. This is sufficiently wide to support two hands of a shooter wrapping both hands around the butt of a handgun. At the rear of the platform is a rear face 112. The platform has a front face 114 which preferably has about the same width as the rear face 112. The upper surface of platform base 104 may have a lip around its perimeter to receive pad 106. Pad 106 may advantageously be made of neoprene. rubber, a compressible plastic, or another resilient, compressible substance.

A pair of sleeves or journals 120 extend forward from platform 102. Preferably journals 120 are integral therewith and are forward of front face 114. Journals 120 include aligned apertures 122 to receive a first pin 124 that is rotatable therein.

First pin 124 also engages a first extension member 130 so that member 130 is rotatable with respect to platform 102. Member 130 includes a complementary pair of arms 132 preferably made of metal, illustratively aluminum. At a first end of extension member 130, each arm 132 includes a first, lower section 134 containing an aperture 1 36 through which first pin 124 passes. A second section 138 extends at an angle 140 from lower section 134. From a fold line or location 142, the extension member 130 includes a third section 144. As shown in the figure, beginning at fold line 142, the width between the arms 132 narrows. Third section 144 continues to close the distance between complementary arms 132 until reaching another fold line 146. Beginning at fold line 146 is a fourth, terminal section 148 of arm 132. Fourth section 148 is parallel to first and second sections 134, 138. Each section 148 includes a respective aperture 150 for receiving and engaging a second pin 152.

Thus first extension member 130 includes a first end at which first pin 124 is located and a second end, distally separated from the first end, at which second pin 152 is located.

Further structure is associated with pin 124 so that the shooter may select and secure the rotational position of the first extension member 130. Thus, a washer 160 made advantageously of a plastic or a non-abrading elastomer, preferably a standard faucet washer, is located between an inside face of first section 134 and an outside face of sleeve 120. Preferably washer 160 faces serrations on both its left and right sides. Thus, according to the preferred embodiment, the inside face of first section 134 contains serrations 162 or is otherwise ridged, and the outside face of sleeve or journal 120 has serrations 163, thereby better to grip washer 160 when a knurled nut, thumbscrew, wingnut, or other easily operated nut 164 is turned on threads 166 (located preferably on only the end of pin 124 opposite to a head) to tighten the arms 132, i.e., to draw them toward one another. When the nut 164 is not tightened, first extension member 130 may be rotated freely (within limits) with respect to platform 102. When it reaches the position desired by the shooter, nut 164 is tightened and the arms 132 are thereby drawn closer to one another, thus engaging the serrations 1 62 , 163 with washers 160 to stop any further rotation.

To achieve the selection of rotational positions of the extension member 130, the combination of serrations 162, 163 with washers 160 has been found optimum and is preferred. However, serrations are not absolutely required for this, and one alternative, albeit less durable, would be to use lock washers, illustratively toothed lock washers, or other mechanical arrangements for holding the first extension member 130 at the angular position selected by the shooter. However, if one were to use lock washers made of steel, arms 132 and 192 may need to be composed of a material other than aluminum, and the washers 160 and 182 may need to be composed of a different, sturdier material than the plastic used in a faucet washer, as it may quickly abrade.

One could alternatively provide an arrangement using detents, or ridges with corresponding channels, allowing the selection of a discrete number of angular settings (rather than the continuously selectable arrangement that has been described above for the preferred second embodiment. In such alternative arrangement, for example, the shooter would squeeze together (or pull apart) the arms to disengage detents or channels from ridges or pins, then rotate the arms to a desired location, and then release them to allow the detent mechanism or ridges and channels to re-engage the arms in any selected one of several predetermined angular positions.

In yet another modification, the provision made in the improved embodiment 100 for securing arms 132 at a selectable angular position can be eliminated, leaving the first extension member 130 freely movable between only the fully closed position and a fully opened operating position used for shooting, as in the first embodiment. Thus, the serrations 162, 163 would be eliminated and hand-operated nut 164 used for tightening would be replaced with a suitable cap or other structure that prevents pin 124 from leaving journals 120 but permits rotation within them. The rotation would be limited by further structure which is included in the preferred embodiment of gun rest 100, as next described.

Preferably platform 102 and the first end of first extension member 1 30 are relatively configured to limit rotation of the extension member 130 to platform 102. Each first section 134 of the arms 132 includes a respective square or non-rounded corner 168 located along the bottom of the section. In FIGS. 8 and 10, square corner 168 is shown at the lower right edge of arm 132. Each arm 132 includes an end face 170 and a bottom edge 172 at the first end. Preferably end face 170 makes about a ninety-degree (90°) angle with bottom edge 172. Preferably the upper right corner 174 of first section 134 is rounded. The rounded upper corner 1 74 permits its corresponding arm 132 to rotate freely, without hitting the front face 114 of platform 102. However, after a certain amount of positive rotation of the first extension member 130 away from platform 102, illustratively on the order of about one hundred forty eight degrees (148°), as when moving the rest 100 from the closed position into a fully opened position, the squared lower corner 168 and the end face 170 move into abutment with front face 114 of platform 102, and further rotation beyond that point is prevented. Preferably the front face 114 of platform 102 is perpendicular to the bottom of platform 102, and when the end faces 170 and corners 168 of the two arms 132 move into abutment with the vertical front face 114 of the platform, the bottom edge 172 of section 134 will be perpendicular to front face 114 and thus parallel to (and preferably co-linear with) the bottom face of platform 102, as represented in FIG. 10. Preferably the second section 138 of extension member 130 makes about a thirty-two degree (32°) angle with the bottom edge 174.

When the shooter "folds" or "winds" gun rest 100 into the storage position, the first extension member 130 lays on top of platform 102 and preferably extends substantially to the rear face 112 of platform 102 and preferably does not extend substantially therebeyond. Further, the width of the first extension member 130 is preferably no greater than the width of platform 102. In some constructions, the length of the first extension member 130 may actually be somewhat less than the length of the platform 102.

The second end (the outer end) of the first extension member 130 will now be described. The fourth section 148 and second pin 152 described above are located at the second end. Just as washers 160 and serrations 162, 163 are used at the first end, such structures are used at the second end also. Hence, fourth section 148 contains aperture 150 through which second pin 152 extends until a head on the pin meets the outside of the side arm 132 fourth section 148. On the inside face of that arm, serrations 180 are formed around aperture 150. Provided next is a washer 182 that corresponds to and is made of the same material as washer 160. The serrations 180 cooperate with the washer 182 in securing the angular position of the second extension member relative to extension 130. Pin 152 extends across the span of first extension 130 at the second end. It passes through another washer 182 and then another aperture 150 having serrations 180 around the inside face of the arm. The far end of pin 152 contains threads 184 that extend beyond the outside of the fourth section 148 of the other arm 132. A suitable wingnut or thumbnut 186 similar to nut 164 is threaded onto threads 184 and operates the same way.

A cylindrical collar or sleeve 188 is located centrally around pin 152. Because the shooter may choose to rest the barrel or other forward portion of the handgun on sleeve 188, it has a resilient outer face or pad of rubber, plastic, or preferably neoprene extending around its entire annular circumference.

Second pin 152 also rotatably engages a second extension member 190. Member 190 includes a pair of preferably complementary arms 192 formed preferably of the same material used for arms 132. Arms 192 have three sections: a first section 194 at a first end of extension member 190, a second (middle) section 196, and a third section 198. The first sections 194 are parallel to but not spaced as far apart as third sections 198. The first section 194 corresponds to a first end of the second extension member 190. The distally spaced end of the third section 198 is referred to as a second end. Thus, in terms of nomenclature, when the gun rest is in an operative position with both extension members unfolded and fully extended, the first end of the first extension member 130 is near to the platform and the second end of member 130 is more remote from the platform. Likewise, the first end of second extension member 190 is nearer to the platform than is the second end of second extension member 190.

Second extension member 130 is rotatably engaged by first extension member 130. Specifically each first section 194 contains an aperture 200 of sufficient diameter to admit the shank portion of second pin 152. The outside face of first section 194 has serrations 202 in the area around aperture 200 to improve the grip on washer 182 when nut 186 is tightened. However, it has been found that serrations 202 are not necessary when serrations 180 are provided on the inside face of fourth section 148 of the first extension member.

Thus, as shown in FIG. 8, pin 152 passes through aperture 150 of one arm 132 of first extension member 130. then serrations 180, then a washer 182, and then the aperture 200 of one arm 192 second extension member 190, thereby rotationally coupling the second extension member to the first extension member. The outside face of arm 192 has further serrations 202 around aperture 200. Thus washer 182 is located between two serrated faces 180 and 202. Pin 152 then passes through padded sleeve 188, then passes through the aperture 200 on the other arm 192 of the second extension member 190, then passes the serrations 202 on the outside surface of that arm 192, then through another washer 182, then serrations 180 on the inside face of arm 132, and then passes through that arm 132. The threads 184 on the end of pin 152 extend beyond the outside face of that arm 132 to allow wing nut or thumb nut 186 to be threaded onto the pin. When the nut 186 is loose, the second extension member 190 is allowed to rotate with respect to the first extension member. The shooter tightens nut 186 to fix the angular position of the second extension member 190 relative to the first extension member 130.

In a variation, the detent arrangement mentioned above for the structure around the first pin 124 could be used for that of the second pin 152. Such detent arrangement would permit the selection of discrete angular positions rather than selecting any position within a continuum of positions, as the illustrated embodiment 100 allows.

It will be appreciated that in this improved embodiment 100, the first end of the second extension member 190 fits within the second end of the first extension member 130, which is the opposite of the first embodiment where arms 50 fit outside the first extension member 28.

In gun rest 100, a stop member is provided to limit the amount of rotation of the second extension member 190. The stop member is preferably a pin 204 that is press-fitted through a corresponding aperture 206 at the extreme end of fourth section 148. When second extension member 190 has rotated away from first extension member 130 a sufficient amount in the positive angular direction, the lower edges of arms 192 meet pins 204. As can be seen from FIG. 9, pins 204 are inwardly facing. The pins described herein allow approximately two hundred seventy degrees (270°) of rotation of the second extension member relative to the first extension member.

Structures other than pins 204 can be used, such as an integral extension or nib from arms 192 extending laterally inward, or screws or a rod that spans the entire distance from one arm 132 to the other arm 132.

The skilled artisan will recognize that pin 204 or other rotation-limiting structure could be located on the second extension member 190 rather than on the first extension member. That is, in the embodiment 100 shown in the figures, the second extension member 190 is allowed to rotate until one of its surfaces encounters the stop pin 204 which is located on the first extension member. One could move the stop pin to the second extension member so that as the second extension member rotates, carrying the pin with it, at some point the pin encounters a surface in the first extension member, thereby to prevent further rotation.

Another alternative would be to include a rotation limiting structure such as a radially extenting nib on the pin 152, and provide a channel or the like within which the nib may move but beyond which it may not pass.

Alternatively, the stop pin 204 can be excluded to allow the second extension member 190 to have unlimited rotation (360°), thereby permitting the shooter to select without limitation the angle of rotation most comfortable or desirable for the gun being used and then securing extension member 190 into that position by tightening the nut 186.

The second extension member preferably fits within the first extension member, as shown in FIG. 9. Thus, the space between fourth sections 148 of arms 132 is wider than the outside width of the first sections 194 of arms 192 of the second extension member 190. The relative configurations and dimensions of the angled sections (second section 196 and third section 144) and the overall length of the second extension member 190 allows the entire second extension member 190 to be rotated to fit between the arms 132 of the first extension member and thus be nested therein. The user may then rotate the second nut 186 to secure this nested position (if desired). He may then rotate the first extension member 130, which at that point houses the second extension member 190, onto the top of the platform 102 and tighten the first nut 164 to secure the gun rest 100 in the closed position.

This configuration permits the second extension member 190 to be rotated downward (through negative angles) from the first extension member 130. Normally it will be rotated upward (through positive angles), however, so that structure at the second end of member 130 can support the gun barrel or other forward portion of the gun.

Specifically, a padded, cylindrical cross member 208 includes an inner cylindrical rod 210 and outer annular pad 212. Rod 210 is threaded at opposed ends of to receive screws 214. A series of holes 216 is located along the length of the third section 198. Advantageously, holes 216 and screws 214 are countersunk. The series of holes 216 allows the shooter to select one pair of them and locate the padded cross member 208 therebetween, selecting the location which works best for the specific handgun being used. The shooter fixes the location of the cross member 208 using a screwdriver or Allen head wrench that corresponds to the screw type. Advantageously, multiple holes 216 are provided. each one centered and equidistant from its nearest neighboring hole. A spacing of approximately three-eighths of one inch center-to-center is suitable, but other spacings can be provided.

Figure 8A:
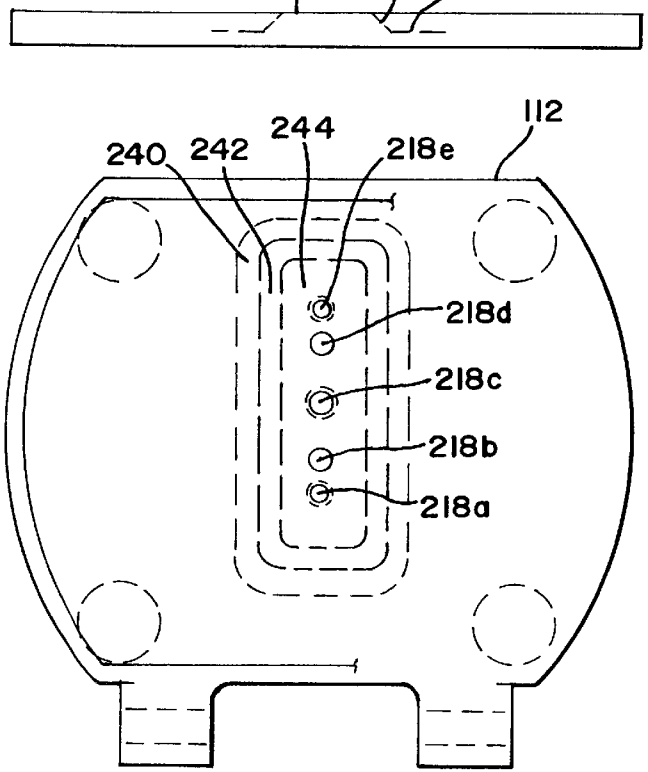
FIG. 8A is a bottom view of the platform of the gunrest of FIG. 8 showing the holes and structure for connecting the platform to a tripod, bipod, or monopod.

The bottom of the platform 102 has one or more holes 218 threaded to receive a standard tripod of the sort commonly used for 35 millimeter cameras, and holes and other fittings to connect a standard Harris bi-pod that has long been used for rifle shooting and is well known to shooters. FIGS. 8 and 8A (a bottom view of platform 102) show such holes and fittings. Advantageously, four pads or feet 219 are placed on the bottom surface or in recesses thereof for the pads so that the platform could be used on a flat surface, such as a shooting bench at a target range. Illustratively, the pads or feet are made of neoprene and extend one-quarter inch down from the bottom surface of the platform 102. However, it will be understood that the primary purpose contemplated for this gun rest 100 is in the field, where a monopod, bi-pod, or tripod will be attached.

FIG. 9 shows a plan view of gun rest 100 in a partially collapsed, partially opened position. As can be seen. the second extension member 190 is nested within the first extension member 130. The two extension members are movable together from this position to the fully closed position. Alternatively, the outer extension member 190 can be moved into the fully opened position or to other positions described below.

Configurations for Use

The gun rest 100 as described is extremely versatile. Not only does it collapse in a two step fashion, as already described, but it can be opened and set into several different arrangements. FIGS. 10 to 13 are representative sketches of some of these orientations. It will be understood that these are not rigorous side views of the rest 100 but instead are simplified sketches to show how the platform 102, first extension 130, and second extension 190 can be oriented for various applications.

FIG. 10 represents rest 100 in its fully opened position. Broken line arrow 220 indicates the rotation of second extension member 190 between the fully closed position and the fully open position. When the shooter rotates member 190 as indicated by arrow 220 for closure, the configuration of FIG. 9 results. The shooter may then rotate the combined first and second extension members 130, 190 together along the path indicated by arrow 222 to close the gun rest 100. To open (fully) the unit from the closed position, the opposite sequence is used, first rotating the two extension members together along arrow 222, and then rotating the second extension member 190 along arrow 220.

The configuration of gun rest 100 as represented by FIG. 10 will be useful for many applications. This position employs the fully opened positions of both extensions 130, 190. That is, no further positive rotation is permitted by the embodiment. The shooter will know in advance which handgun is to be used and can adjust in advance the location of padded cross member 208 so that the barrel of the handgun is parallel to the platform 102.

Figure 11:
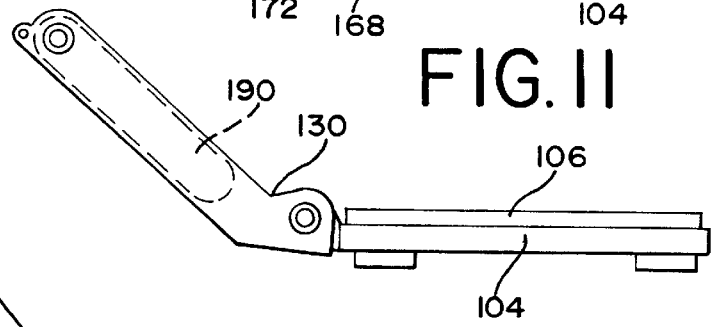
FIG. 11 is a representative side view sketch for the embodiment of FIG. 8 in the configuration of FIG. 9, where the inner cross member may support the barrel or forward portion of the gun at an elevated position forward of the platform.

FIG. 11 represents the rest 100 in the partially open-partially closed position corresponding to FIG. 9. The shooter could use the rest 100 in this intermediate position, resting the forward portion of the handgun on the padded sleeve 188.

Figure 12:
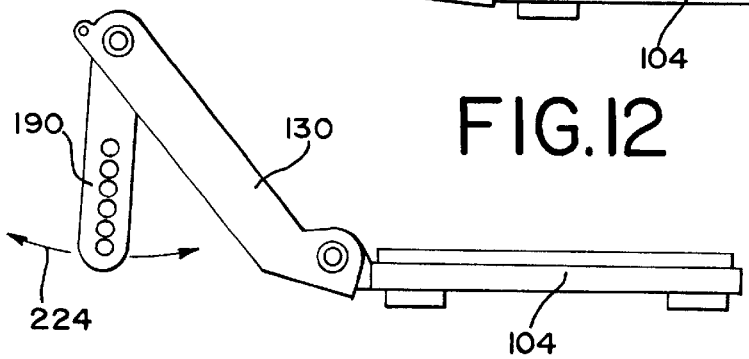
FIG. 12 is a representative side view sketch for the embodiment of FIG. 8 in a configuration allowing the inner cross member to support the barrel or forward portion of the gun at an elevated position forward of the platform and allowing the second extension member to brace the first extension member in front of the platform.

FIG. 12 represents another position where the forward portion of the handgun is to be rested on padded sleeve 188 at the second end of first extension member 130. The second extension member 190 is rotated downward from the position shown in FIG. 11 and extends generally vertically downward to provide a forward support. The shooter can set the member 190 to be vertical or can continue the rotation as indicated by the arrow 224. The position of FIG. 12 is for use upon a flat surface such as a table or bench.

Figure 13:
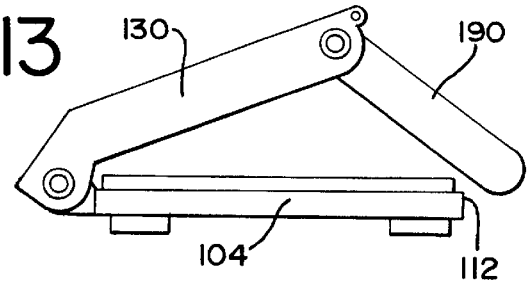
FIG. 13 is a representative side view sketch for the embodiment of FIG. 8 in a configuration allowing the inner cross member to support the barrel or forward portion of the gun at a position that is elevated from but not forward of the platform, and allowing the second extension member to brace the first extension member from the rear of the platform.

FIG. 13 represents a further position where the gun rest 100 is configured for resting the barrel on padded sleeve 188. The rest 100 has the first extension member 130 opened only slightly from the fully closed position so that padded sleeve 188 is located directly above platform 104. The second extension member 190 is opened to about ninety degrees (90°) so that its second end rests on the table, bench, or ground beside the rear face 112. Thus a three-sided configuration results, as represented in the figure. In a modification of this configuration, the shooter may rest the second end of the second extension member 190 directly upon the upper surface of pad 106, rather than behind the platform 102.

Figure 14:
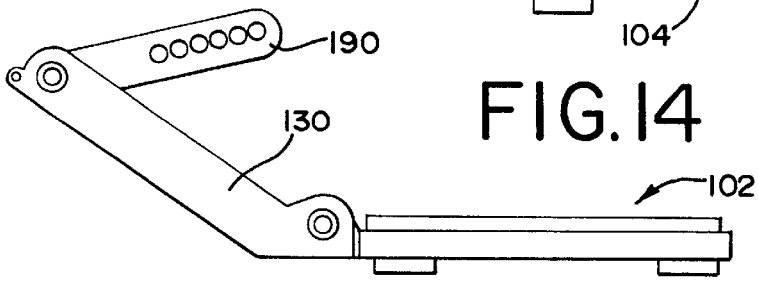
FIG. 14 is a representative side view sketch for the embodiment of FIG. 8 in another configuration allowing the outer cross member to support the barrel or forward portion of the gun at an elevated position which is forward of the platform.

FIG. 14 represents a position which will be useful for many handguns. In this configuration, the first extension member 130 is rotated away from platform 102 to the limit allowed. Thus, the extension member 130 is moved until its face 170 meets the confronting front face 114 of the platform 102, thereby affirmatively stopping further relative rotation of arms 132. The second extension member 190 is rotated upward through a positive acute angle from its closed position (nested within first extension member 130) to the position shown in the figure. The shooter rests the butt or grip of the handgun on the platform 102 and rests the barrel or other forward portion of the gun on the padded cross member 208, which in this configuration is elevated in height with respect to the platform and is forward of the front face 114 of platform 102.

It will thus be appreciated that many combinations of angles are possible with the gun rest 100. In FIG. 10, both extension members have been moved through obtuse angles. Arrows 220 and 222 both subtend angles greater than ninety degrees (90°). In FIG. 11, one extension member (130) has moved through an obtuse angle, and the other extension member (190) has not rotated, i.e., still has zero degrees of rotation relative to its axis of rotation (second pin 152). In FIG. 12, one extension member (130) has moved through an obtuse angle and the other extension member (190) has moved through a negative acute angle. In FIGS. 13 and 14, one extension member has moved through an acute angle and the other through an obtuse angle. That is, in FIG. 13, the first extension member 130 has moved through an acute angle and the second extension member 190 has moved through an obtuse angle. In FIG. 14, on the other hand, the first extension member 130 has moved through an obtuse angle and the second extension member 190 has moved through an acute, positive angle.

In all cases, a rotational step brings a padded cross member, either padded sleeve 188 or padded cross member 208, into a position to support the forward portion of the gun. In FIGS. 10 and 14, the cross member 208 supports the gun. In FIG. 11, 12, and 13, the cross member 188 supports the gun and the second extension member is either not used (as in FIG. 11) or is used for bracing (as in FIGS. 12 and 13). The position of FIG. 13, however, does not support the rear of the handgun nor the hand of the shooter. This position may be used when such support is not desired or not needed, or for supporting a rifle rather than a hand gun.

The gun rest 100 thus has substantial versatility in supporting handguns in the field, and is usable too for shooting from a bench. Further, it is usable for supporting the forward portion of a rifle if the shooter so desires. Using the nominal sizes that are set forth below for the gun rest 100, the shooter may employ the full extension of both extension members 130, 190 (as represented by FIG. 10) for long, specialty handguns and long-barreled revolvers. The user selects the optimum location of cross member 208 along the plurality of holes 216 so that when the butt of the handgun is on the platform, the barrel of the gun is parallel with the platform. However, this adjustment is not critical when the gun rest 100 is mounted on a bipod for field use because of the shooter's ability to "rock" the bipod to and fro (thereby to level the barrel). Of course, for some hunting, the shooter will not want the barrel to be perfectly level, as for example when the expected target is low to the ground. For bench use, however, the adjustment of cross member 208 is important. On the other hand, the shooter can also rotate the second extension member 190, thus causing the cross member 208 to arc upward to meet the point of contact under the handgun, and then secure the extension member 190 it into that optimum position.

For shorter handguns, the shooter can leave the second extension member 190 nested within extension member 130, as represented by FIG. 11, and use the inner cross-member (padded sleeve 188) for support under the handgun, again, bringing it up and under the handgun and securing it into position.

An alternative for shorter handguns is the configuration represented by FIG. 14. The shooter can use the (outer) cross-member 208, but instead of extending the second extension member 190 away from the platform, i.e. where member 190 has been rotated through an angle greater than ninety degrees (90°) as represented in FIG. 10, the shooter moves extension member 190 through only an acute positive angle from the fully-extended position of first extension member 130. Thus, the padded cross member 208 is closer to the platform than is padded sleeve 188 and padded cross member 208 will be higher in elevation than padded sleeve 188.

It is anticipated that the configurations of FIGS. 10 and 14 will be used most often.

The use of negative angles of rotation will generally be confined to using the rest 100 on a shooting bench. For bench shooting, one may configure rest 100 using positive or negative angles. For field shooting, using detachable legs as described, generally only positive angles will be used. However, the ability of the preferred embodiment rest 100 to permit negative angles of rotation of second extension member 190 is a significant advantage which makes rest 100 so versatile.

The tightening of extension members 130 and 190 does not have to be excessive to secure the rotational positions of the extension members This is attributable to the combination of the serrations 162, 163 with washers 160, and serrations 180 and 202 with washers 182. Preferably, washers 160, 182 are standard faucet washers. A moderate tightening is enough for the extensions to hold position under recoil. Extensive testing shows that the embodiment of gun rest 100 described herein meets these requirements.

For bench use, the shooter can rest the butt of the handgun on the platform, acquire the target through the sites, and adjust the outer cross-member 208 to come under the handgun to hold that position, and secure the position. How one sets up the rest 100 depends on the size of the handgun, and because the rest can be used in so many positions, adjusting the outer cross-member along the plurality of holes often is not necessary.

In the field, the shooter will attach the gun rest 100 to a leg structure using the threaded holes and other structures on the bottom of platform 104. As noted, one may use a tripod, bipod, or monopod. The latter two offer more flexibility in permitting the gun rest 100 mounted thereon to be canted forward or back with no mechanical adjustments.

Construction

In terms of dimensions and other aspects of construction, some of the preferred dimensions of the platform 102 have been stated above. It will be understood that the platform has a preselected size that is sufficiently large to accommodate a wide variety of handguns and shooters but sufficiently small to permit easy carrying of the collapsed device, illustratively in a holster, pocket, or shooting case. Thus, the presently-preferred platform size is about 4.75 inches long with a width of about 4.25 inches across the rear face 112, a maximum width of about 6.0 inches across the middle of the platform 102, and about 4.5 inches across the front face 114 of the platform. Preferably the width of the first extension member 130 at the first section of its arms 132 is substantially the same as the width of the front face of the platform, in this case about 4.5 inches. Preferably the length of the first extension is about 5.25 inches, with the pins 124, 152 being about 4.625 inches apart center-to-center. Preferably the width of the first extension member 130 measured at the fourth sections 148 of arms 132 is about 2.875 inches (outside dimension). exclusive of the pin head and nut 164. Preferably the third section of each arm 132 is about 1.125 inches long. Preferably the padded sleeve 188 is about two inches long with an outside diameter of about 0.75 inches or slightly greater. Preferably the length of second extension member 190 is 4.5 inches end-to-end. The first section 194 is sufficiently wide to contain the padded sleeve 188 and sufficiently narrow to fit within the fourth sections 148 of the first extension member 130. Illustratively, the width from the outside of one first section 194 to the outside of the other first section 194 is about 2.25 inches. Preferably the corresponding width of the third sections 198 of the second extension member 190 is about 3.5 inches. Preferably the padded cross member 208 is about 3.25 inches long by about 0.75 inches outside diameter.

Preferably the platform and extension arms are made of aluminum. Since the gun rest is intended to be carried with the shooter into the field for hunting use, lightweight materials are preferred. However, they must be substantial enough to give good support to a handgun which could be fairly heavy and must not distort appreciably when the gun is fired. Though aluminum is preferred, steel could be used, or various other alloys or synthetic composites.

The resilient pad 106 and the outer faces on cylindrical members 188 and 208 preferably are made of neoprene, but other rubber or resilient plastics could be employed. Any solid or closed cell sponge rubber/plastic can be used for pad 106 provided that it is durable and protects the finish of the firearm. Similarly, the padding used on sleeve 188 and cross member 208 must be durable and protect the finish of the firearm. Rubber or neoprene compounds are suitable.

As mentioned, washers 160 and 182 are preferably standard faucet washers. Made of plastic, they are durable, work well with the serrations 162, 163, 180, and 202, and with only a moderate tightening of knurled or wing nuts 164. 186, hold steady the orientation selected by the shooter notwithstanding the recoil of the weapon used upon it.

Preferably the wing nuts or knurled nuts 164, 186 are located on the left side of gun rest 100. In that way, a right-handed shooter will be able to hold the weapon with the right hand and make adjustments with the left hand. In the event that the rest is to be used by a left-handed shooter, the design permits easy conversion by removing nut 164, withdrawal of pin 124 via the right one of extension arms 132, moving it to be inserted via the left one of extension arms 132, and securing nut 164 on the right side instead of the left. A similar operation is easily performed on pin 154 and nut 186.

Conclusion

The embodiments described herein provide a platform of preselected size, the dimensions of which allow the gun rest to support a man's wrists and hands gripping a handgun when the butt of that gun is rested on the platform. The rests described herein thus provide a platform support which is completely unencumbered with structure that supports other parts of the rest. The gun rest is compact in size, unlike a bench or rest designed for use with a rifle. The compact size of the gun rest of the embodiments described herein allows them to be carried in a coat pocket, in a suitable carry sheath, or in a shooting box.

Importantly, the rest provides support for the forward portion of the gun at an elevated position. The position of forward support is selectable over a wide range. The rest also provides support for the hand or hands and wrist or wrists of the shooter, and thus provides two position support (fore and aft).

Additionally, a single gun rest as described herein with two extension members, one connected rotatably to the front of the platform, the other connected rotatably to the front (second end) of the first extension, accommodates a wide variety of handguns due to its extreme versatility of support positions. It accommodates handguns that are large and small. The construction of the gunrest supports even heavy handguns equipped with telescopic sighting.

Set up of the preferred embodiment gun rest is extremely simple. It opens and collapses by simple rotation. To open it from a closed position, one rotates the first and second extension members together, in a single step, by rotating them about an axis that is located at the front periphery or front edge of the platform, or just forward of it. That axis of rotation is at a first end of the first extension member. Then, in a second rotation step, the second extension member is rotated away from the first extension member by rotation about a second axis which is at a second end of the first extension member. The first and second ends are spaced apart, and thus the first and second axes of rotation are spaced apart. Thus it will be appreciated that the second axis of rotation is not connected directly to the platform and is, instead, distally separated therefrom.

After opening the rest, if the selected position is other than fully open, where the positive stop mechanisms are used, then the user secures the first and/or second extension members in the desired positions. The operative position will depend on the size and shape of the handgun or other gun, and the second extension member may sometimes not be used at all and remain nested within the first extension member, or it may be moved through a positive or negative angle. The second extension member may be used to provide bracing when the shooter opts to rest the forward portion of the gun on the inner cross member (padded sleeve 188), as in FIGS. 12 or 13.

To close the gun rest, in a first step the second extension member is (unsecured and) rotated into its nesting position within the first extension member, and in a second step the two of them are (unsecured and) together rotated onto the upper surface of the platform.

It will be understood that in a variation of the improved embodiment 100, the two extensions could rotate to a closed position under the platform rather than on top of it. The square comer 168 of the first extension member 130 would then be replaced with a rounded corner to permit rotation of the first extension member all the way to the underside of platform 102. The shooter would then rely on the tightening mechanism only for maintaining the angle of rotation of extension 130, or a supplemental stopping arrangement could also be provided. This variation is considered to be less optimum than the embodiment 100 described herein where the extensions rotate onto the top of the platform, as that position allows for positive stop mechanisms to limit the amount of rotation.

Another independent feature of the preferred embodiment is its versatility in connecting to leg supports. As noted herein, the gun rest may be attached to a monopod, bipod, or tripod. The combination with a bipod is especially advantageous since the bipod allows canting of the rest in forward and rearward directions, allows height adjustment, and is smaller and lighter than a tripod. The structures on the bottom of platform 102 permit this versatility. The five preferred holes 218 of Fig. 8 are shown as 218*a, b, c, d*, and *e* in FIG. 8A. The center hole 218*c* is tapped for a standard camera tripod, typically ¼×20. The standard camera tripod has a removable shoe and a ¼×20 threaded stud for attachment, along with a spring loaded stud for alignment. Untapped holes 218*b* and 218*d* are positioned to receive such a spring loaded stud of the standard camera tripod.

Holes 218*a* and 218*e* are preferably threaded 10×32 holes which therefore correspond to a receive a standard rifle sling stud. The well-known Harris bipod attaches to such standard rifle sling stud. The bottom of the platform preferably is milled to conform to the shape required to receive the Harris bipod. Hence, it includes a channel 240, an angled face 242, and a central region 244. Angled face 242 may extend completely around central region 244 or may comprise just two separated portions running the length of central region 244 but not its width. This milled shape stabilizes the bipod.

It will also be understood that the second embodiment 100 could be modified to include the bracket 18 of the first embodiment, and thus include legs which may be folding or telescopic or both.

Inasmuch as the present invention is subject to modification, and variations may be made without departing from the concept or scope of the invention described herein, along with equivalents which may be resorted to, it is intended that the description of the present embodiment be representative and not restrictive.

I claim:

1. A gun rest comprising:

a platform having a predetermined size that is commensurate in size with at least one hand of a shooter holding a grip of a handgun, the platform having a front edge;

first and second extension members, each having respective first and second opposed, distally spaced ends;

said first end of said first extension member being coupled rotationally to said platform at said front edge thereof;

said first end of said second extension member being rotationally coupled to said second end of said first extension member;

said second extension member not being directly coupled to said platform; and at least one support member associated with at least one of said extension members for supporting a forward portion of said handgun on said support member.

2. The gun rest of claim 1 wherein said second extension member is rotatable through positive and negative angles with respect to said first extension member.

3. The gun rest of claim 1 wherein said at least one support member comprises:

a first support member located at said second end of said first extension member; and a second support member located on said second extension member.

4. The gun rest of claim 1 further comprising a securing mechanism to permit at least one of said extension members to be secured in a rotational position selected by the shooter.

5. The gun rest of claim 4 wherein the securing mechanism comprises at least one serrated surface, an annular member, and a manually operated tightening apparatus to tighten said at least one annular member against said at least one serrated surface.

6. The gun rest of claim 1:

wherein said platform includes at least one journal at said front edge;

wherein said first extension member includes first apertures and a first pin;

wherein said first pin extends through said first apertures and said at least one journal;

wherein said securing mechanism comprises at least one washer, serrations radially outward from said pin and adjacent to said washer, and a manually tightening member for compressing said washer against said serrations.

7. The gun rest of claim 6 wherein said washer is positioned between said journal and an inside surface of said extension member;

wherein first serrations are included on a face of said journal adjacent to said washer;

wherein second serrations are included on an inside face of said first extension member; and wherein said tightening member compresses said washer against both said first serrations and said second serrations.

8. The gun rest of claim 1 further comprising a stop member which is located on one of said extension members for limiting an amount of rotation.

9. The gun rest of claim 8 wherein said stop member is located at said second end of said first extension member and limits the amount of rotation of said second extension member relative to said first extension member.

10. The gun rest of claim 1 further comprising first and second stop members located on a said extension member for limiting rotations of said first and second extension members.

11. The gun rest of claim 10 wherein said first stop member comprises a surface located at said first end of said first extension member, said surface being located to move into abutment with said platform after a predetermined amount of rotation of said first extension member relative to said platform, thereby to prevent further rotation therebetween.

12. The gun rest of claim 11 wherein said second stop member is located at said second end of said first extension member and limits the amount of rotation of said second extension member relative to said first extension member.

13. The gun rest of claim 1 further comprising a stop member located on said first extension member, said stop member extending into a path of rotational travel of said second extension member, thereby preventing rotational travel beyond said stop member.

14. The gun rest of claim 1 wherein at least one of said first and second extension members comprises a pair of spaced apart arms.

15. The gun rest of claim 1 wherein said first extension member comprises:

a first pair of spaced apart arms;

a first pin located at said first end of said first extension member; and a second pin and a first cross member located at said second end of said first extension member.

16. The gun rest of claim 15 wherein said second extension member comprises:

a second pair of spaced apart arms;

said second pair of arms being rotationally coupled to said second pin; and a second cross member located at said second end of said second extension member.

17. The gun rest of claim 16 wherein said second pair of spaced apart arms straddles said second cross member and at said second pin is located between said first pair of spaced apart arms.

18. The gun rest of claim 16 wherein said second pair of spaced apart arms includes a plurality of mounting locations for mounting said second cross member, and wherein said second cross member is mounted in a selectable one of said mounting locations.

19. The gun rest of claim 15 further comprising a manually operated tightening member for manually drawing said first pair of spaced apart arms toward each other thereby to secure said arms in rotational position.

20. The gun rest of claim 16 further comprising:

a first manually operated tightening member for manually drawing said first pair of spaced apart arms toward each other thereby to secure said first pair of arms in rotational position; and a second manually operated tightening member for manually drawing said second pair of spaced apart arms toward each other thereby to secure said second pair of arms in rotational position.

21. A handgun rest for use by a shooter comprising:

a platform having a predetermined size that is commensurate in size with at least one hand of a shooter holding a grip of a handgun;

a first extension member coupled to a forward portion of said platform;

a second extension member coupled to said first extension member;

a first rotational coupling device coupled between and permitting rotation between a selected one of (a) said first extension member and said platform and (b) said first extension member and said second extension member;

a manually operated securing mechanism coupled to said first rotational coupling device to permit the shooter to select an amount of rotation and secure a selected rotational position of a selected one of said first extension member and said second extension member;

wherein said platform provides support for a hand of the shooter holding the handgun grip and a selected one of said first and second extension members provides support for a forward portion of said handgun.

22. The handgun rest of claim 21 wherein said securing mechanism comprises an annular member, at least one serrated face adjacent to said annular member, and a tightening apparatus for tightening said annular member against said at least one serrated face.

23. The handgun rest of claim 21 further comprising a rotation limiter located on a selected one of said first and second extension members and located in the path of travel of said at least one member coupled for rotational movement thereby to prevent rotation beyond the position of said rotation limiter.

24. The handgun rest of claim 21 wherein a selected one of said first and second extension members further comprises a cross member for resting a forward portion of the gun thereon.

25. The handgun rest of claim 21 wherein said first extension member further comprises a first cross member for resting a forward portion of the gun thereon and said second extension member further comprises a second cross member for resting a forward portion of the gun thereon, whereby when the shooter moves the extension members into a desired position, a selected one of said first and second cross members supports the forward portion of the gun.

* * * * *